US006438883B1

(12) United States Patent
Kacius

(10) Patent No.: US 6,438,883 B1
(45) Date of Patent: Aug. 27, 2002

(54) PICTURE CABINET

(75) Inventor: Timothy A. Kacius, Torrance, CA (US)

(73) Assignee: Tinker's Den, Inc., Torrance, CA (US)

( * ) Notice: Subject to any disclaimer, the term of this patent is extended or adjusted under 35 U.S.C. 154(b) by 0 days.

(21) Appl. No.: 09/336,484

(22) Filed: Jun. 18, 1999

(51) Int. Cl.[7] ..... A47G 1/06

(52) U.S. Cl. ..... 40/735; 40/712; 40/768; 40/778; 40/740; 40/794

(58) Field of Search ..... 40/611, 617, 712, 40/722, 723, 724, 735, 768, 771, 778, 740, 792, 794

(56) References Cited

U.S. PATENT DOCUMENTS

| | | | | | |
|---|---|---|---|---|---|
| 132,314 | A | * | 10/1872 | Moulton | 40/732 |
| 231,473 | A | * | 8/1880 | Brower | 40/765 |
| 3,589,049 | A | * | 6/1971 | Cornelius | 40/722 |
| 3,599,361 | A | * | 8/1971 | Bowman | 40/711 |
| 3,905,139 | A | * | 9/1975 | Cooper | 40/545 |
| 4,117,613 | A | * | 10/1978 | Hosker | 40/735 |
| 4,423,563 | A | * | 1/1984 | Ondricek | 40/533 |
| 4,553,344 | A | * | 11/1985 | Rubin et al. | 40/735 |
| 4,702,534 | A | * | 10/1987 | Witt et al. | 313/114 |
| 4,899,473 | A | * | 2/1990 | Wiener | 40/779 |
| 4,947,565 | A | * | 8/1990 | Shadwell | 40/779 |
| 5,096,752 | A | * | 3/1992 | Wagner | 428/13 |
| 5,161,827 | A | * | 11/1992 | Grosso | 283/77 |
| 5,283,967 | A | | 2/1994 | Abrams | |
| 5,353,536 | A | * | 10/1994 | Erber et al. | 40/611 |
| 5,392,545 | A | * | 2/1995 | Claman et al. | 40/702 |
| 5,680,721 | A | * | 10/1997 | Hine, Jr. | 40/611 |
| 5,787,626 | A | * | 8/1998 | Bingham et al. | 40/735 |
| 5,979,097 | A | * | 11/1999 | Moore | 40/769 |
| 6,101,752 | A | * | 8/2000 | Cumberland | 40/778 |

* cited by examiner

*Primary Examiner*—J. J. Swann
*Assistant Examiner*—Andrea Chop
(74) *Attorney, Agent, or Firm*—Michael A. Carrillo; Gary R. Jarosik; Mark R. Galis

(57) ABSTRACT

A picture frame capable of storing more than one picture, which includes a front frame member hingeably and removably attached to a rear support member, where the front frame member includes a frame surrounding a transparent display window and where the rear support member includes a picture compartment for storing pictures. The front frame member also includes a removable mat board mounted on the inside of the transparent window. The mat board forms a border on the inside of the display window and is releasably secured to the front frame member by flexible support arms. The front frame member and the rear support member are connected by a pair of releasable and interrelating fasteners mounted on the front frame member and the rear support member, respectively, for releasably securing the front frame member to the rear support member. The picture compartment includes an automatically adjusting, removable rear picture support removably mounted within the picture compartment. Moreover, a compressible material is displaced between the picture compartment and the rear picture support. The compressible material places a constant, yet variable, force upon the rear picture support in the direction of the display window.

14 Claims, 6 Drawing Sheets

PICTURE CABINET

BACKGROUND OF THE INVENTION

1. Field of the Invention

The invention relates generally to picture frames or picture cabinets, and more particularly to picture cabinets which are capable of holding more than one picture, post-card, drawing, greeting card, document or object of a size which allows it to fit within the picture cabinet and which users would like to display (herein generally referred to as "pictures") in a single frame. More particularly, it is an object of the present invention to provide a novel picture frame capable of supporting a varying number of photographs in a varying number of picture support compartments while also allowing the picture frame to be accessible while said picture frame is mounted on a planar surface such as a wall.

2. Description of the Prior Art

It is known in the art to provide picture frames capable of displaying multiple pictures. For example, picture frames including several display areas within a single set of frame borders and picture frames providing multiple and corresponding picture support compartments are known in the art. Moreover, it is known in the art to provide removable mat boards with picture frames. It is not known, however, to manufacture picture frames with removable picture support compartments and matching, removable mat boards.

Conventional frames also exist which allow users to access such frames while such frames are mounted on a wall or other planar support. For example, U.S. Pat. No. 5,283,967 issued to Abrams discloses a picture frame capable of being accessed while the frame is mounted on a wall. More specifically, this patent describes a frame which utilizes a piano-type hinge means comprising a front L-shaped leaf and a rear U-shaped or C-shaped leaf formed to interact with a C-shaped rear channel of the front frame. Manufacture of this frame, however, requires significant extra tooling and design to allow the hinge means and front frame to interact in a manner that allows the picture frame to be opened without removing the picture frame from the wall.

Additionally, it is also widely known to provide picture frames or storage units capable of holding more than one picture in a single picture support compartment. Again, U.S. Pat. No. 5,283,967 to Abrams discloses a picture frame capable of supporting multiple pictures or thicker documents, such as comic books, within a single picture support compartment. This patent does not, however, disclose the combination of a picture frame which includes multiple picture support compartments, each compartment being capable of holding multiple pictures substantially flush within the picture frame display window.

It is therefore an object of the present invention to provide a picture frame which overcomes the problems associated with the prior art.

SUMMARY OF THE INVENTION

The foregoing features and advantages of the present invention are achieved by providing a picture frame or picture cabinet capable of storing more than one picture, post-card, drawing, greeting card, document or object of a size which allows it to fit within the picture cabinet and which users would like to display (herein generally referred to as "pictures"). The picture frame is comprised of a front frame member hingeably and removably attached to a rear support member, where the front frame member includes a frame comprised of four frame borders surrounding a transparent display window and where the rear support member is comprised of a rear frame member with a groove provided on the inside of the rear frame member. In addition, the front frame member includes a removable mat board mounted on the inside of the transparent window which forms a border on the inside of the display window. The mat board is releasably secured by flexible support arms attached to the frame borders. The front frame member and the rear support member are connected on one side by at least one hinge. Moreover, attachment means for releasably securing the front frame member to the rear support member are provided. An automatically adjusting, removable rear picture support is securably attached to the rear support member by corner supports. Also, an adjustment means is displaced between the rear panel and the rear picture support. The adjustment means places a constant, yet variable, force upon the rear picture support in the direction of the display window.

The foregoing and other features and advantages of the present invention will be apparent from the following more detailed description of the invention.

DETAILED DESCRIPTION OF THE PREFERRED EMBODIMENT

While this invention is susceptible of embodiments in many different forms, there is herein described in detail, a preferred embodiment of the invention with the understanding that the present disclosure is to be considered as an exemplification of the principles of the invention and is not intended to limit the broad aspects of the invention to the embodiments illustrated herein.

Figure 1:
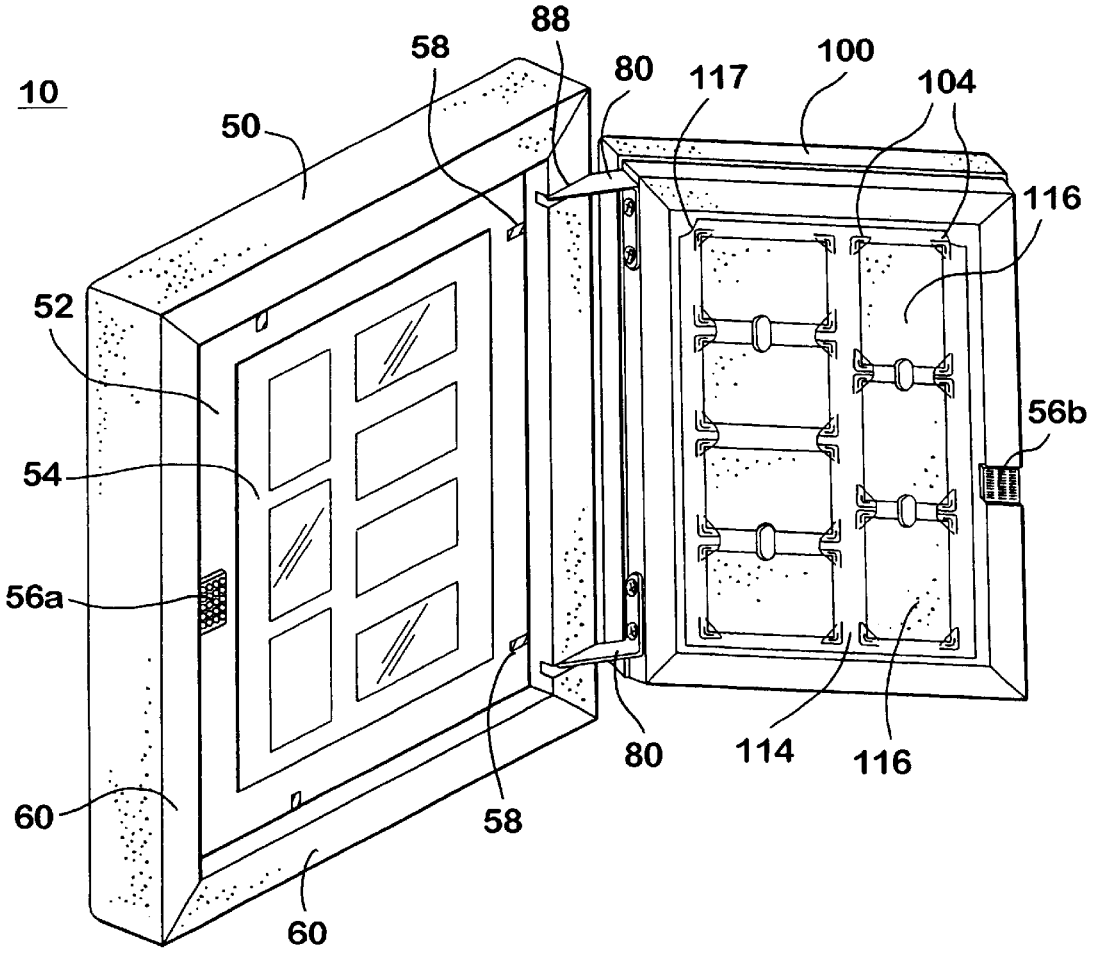
FIG. 1 is a perspective view of a preferred embodiment of the present invention in an open position.

In the preferred embodiment of the invention and as exemplified in FIG. 1, a picture frame or picture cabinet 10 with multiple picture compartments 116, capable of storing more than one picture, post-card, drawing, greeting card, document or object of a size which allows it to fit within the picture cabinet and which users would like to display (herein generally referred to as "pictures") in each compartment 116, is provided. The picture frame 10 is comprised of a front frame member 50 hingeably and removably attached to a rear support member 100. The front frame member 50 is comprised of frame borders 60 which surround a transparent display window 54, which could be constructed of glass, plastic or other transparent materials of a similar nature. The front frame member 50 also includes a removable mat board 52 mounted on the inside of the transparent display window 54. The mat board 52 forms a border on the inside of the display window 54 and is releasably secured to the display window 54 by flexible support arms 58 attached to the frame borders 60. The front frame member 50 is releasably connected to the rear support member 100 and connected on one side by two hinges 80, however, the present invention could be altered to include only one hinge 80 or more than two hinges 80.

Figure 4:
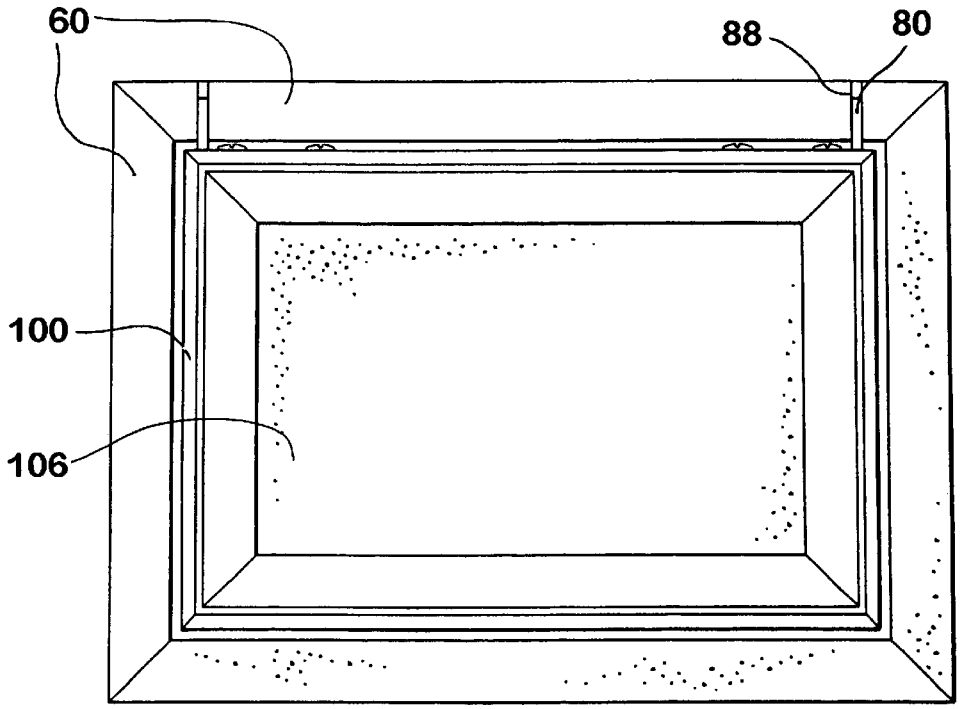
FIG. 4 is a rear elevational view of the present invention.
Figure 5:
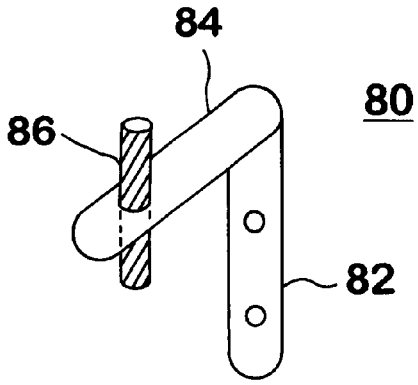
FIG. 5 is an enlarged, perspective view of the hinge shown in FIG. 1.
Figure 6:
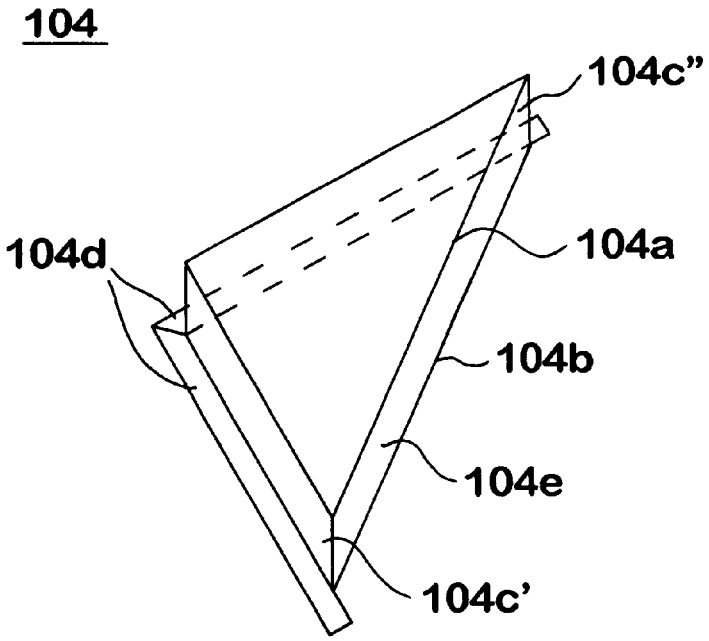
FIG. 6 is an enlarged, perspective view of the corner support shown in FIG. 1.

As shown in FIG. 5, the hinge 80 is comprised of an L-shaped member having a first leg 82 and a second leg 84. The first leg 82 is attached to the rear support member 100 and the second leg is rotatably attached to a support pin 58 which is attached to the front frame member 50. Further, as shown in FIG. 4, the front frame member 50 includes a hinge slit 88 that runs perpendicular to the frame border 60 on which the hinge slit 88 is located. The support pin 86 is located within and perpendicular to the hinge slit 88. The second leg 84 fits within the hinge slit 88 and is rotatably connected to the support pin 86, thereby allowing the front frame member 50 to rotate in the same plane as the rear support member 100. This allows the picture frame 10 to be opened up to 180 degrees without removing the picture frame from the wall or other plane or surface on which it is mounted.

Figure 2:
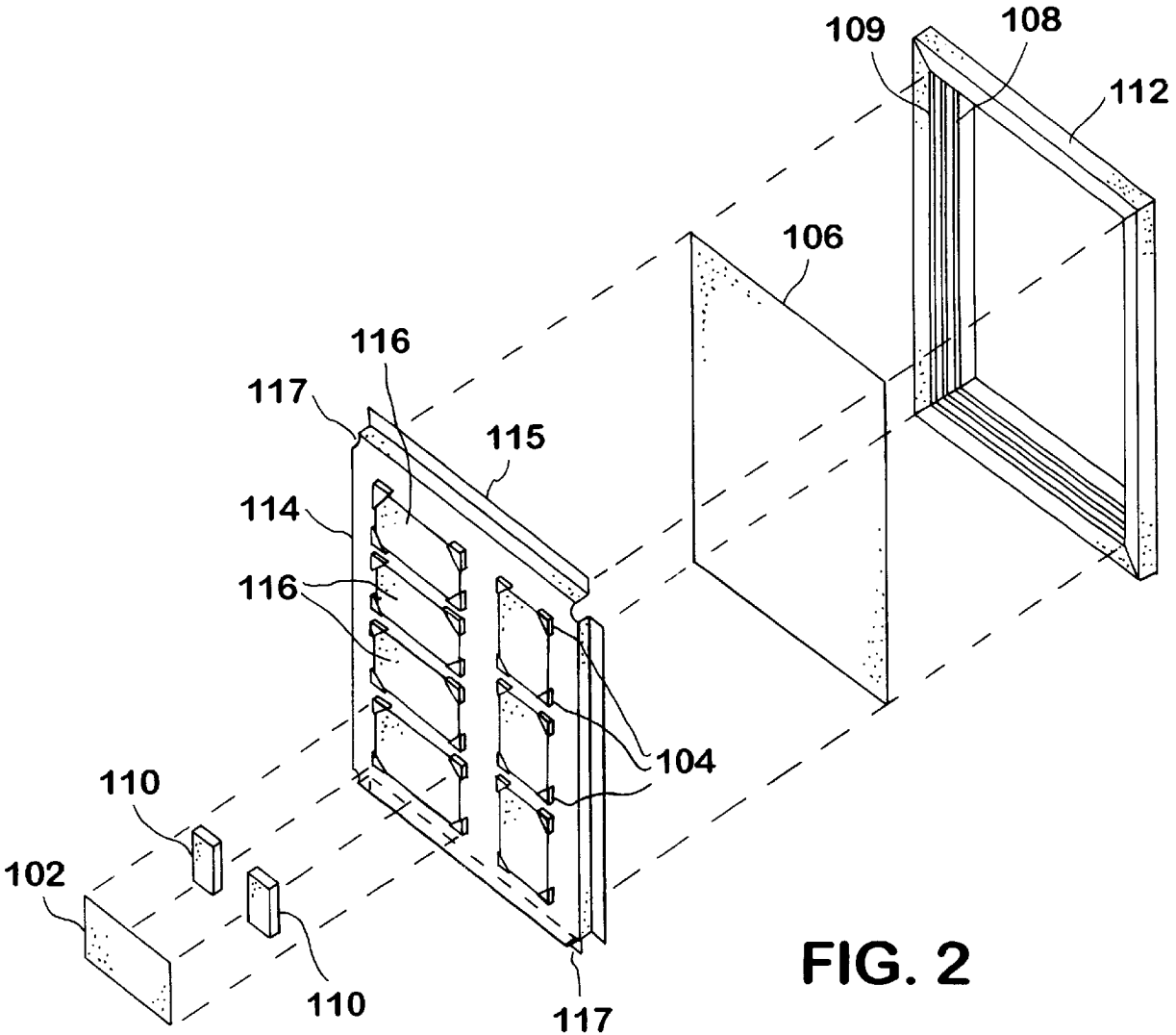
FIG. 2 is an exploded view of the rear support member of the preferred embodiment of the present invention.
Figure 3:
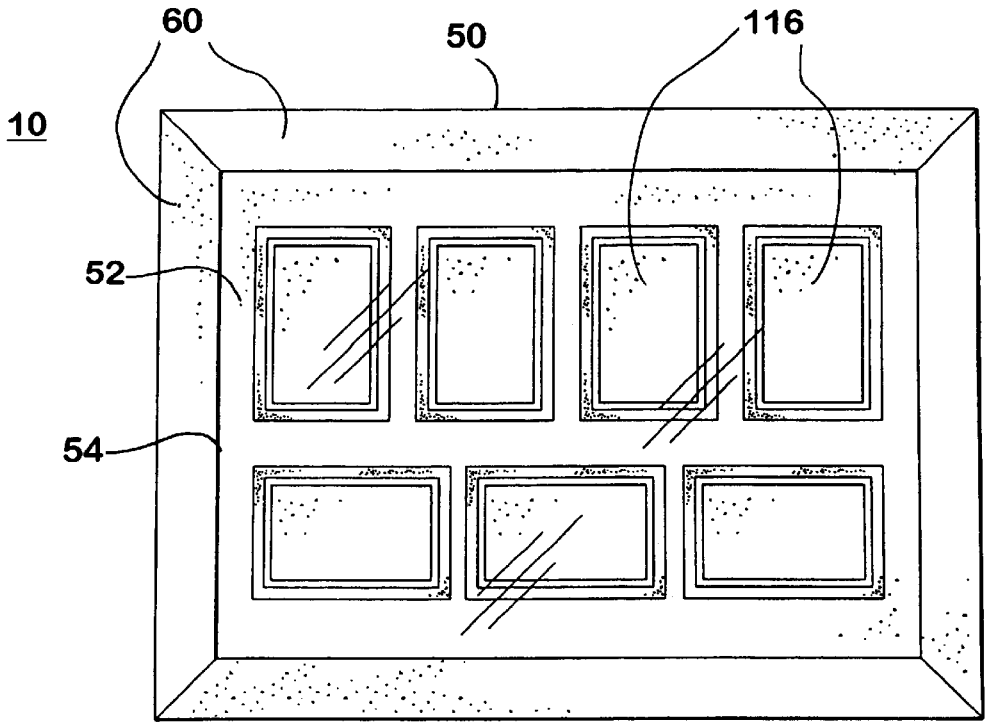
FIG. 3 is a front elevational view of the present invention.

As shown in FIG. 1, the rear support member 100 is hingeably connected to the front frame member 50. Further, as shown in FIG. 2, the rear support member 100 is comprised of a rear frame member 112 with a groove 108 provided on the inside portion of the rear frame member 112. A rear panel 106 is mounted within the groove 108 of the rear frame member 112. Also, a channel 109 is provided on the inside portion of the rear frame member 112 between the groove 108 and the front frame member 50. A picture compartment support 114 is mounted within the channel 109 of the rear frame member 112 where the edge 115 of the picture compartment support 114 is positioned within the channel 109. In the preferred embodiment and as shown in FIG. 1, the picture compartment support 114 includes at least one picture compartment 116 and each of the picture compartments 116 includes integral corner supports 104. The picture compartment support 114 also includes at least one corner aperture 117 which allows the picture compartment support 114 to be removed by securing the picture compartment from within the corner aperture 117. As described below in a discussion of the alternative embodiment, the corner supports 104 can be separate from the picture compartment support 114.

Moreover, an adjustment means 110 and a rear picture support 102 are removably secured within each picture compartment 116 by the corner supports 104. The rear picture support 102 is comprised of a flexible material, such as, cardboard. Thus, the rear picture support 102 can be removed from the respective picture compartment 116 by flexing or bending the rear picture support 102 to avoid some of the corner supports 104 thereby allowing the rear picture support 102 to be removed. The adjustment means 110 is comprised of a compressible, yet resilient, material such as a sponge or spring. Thus, the adjustment means 110 places a constant, yet variable, force upon the rear picture support 102 toward the display window 54.

A releasable attachment means 56 is provided, on the opposite side of the front frame member 50 and rear frame member 112 from the hinge 80, to releasably attach the front frame member 50 to the rear support member 100. One type of attachment means includes a lever with a hook shaped portion that is securably and releasably attachable to a protrusion, such as a screw head, nail head or similar item, and the hook shaped portion of the lever partially encompasses at least a portion of the protrusion. Another type of attachment means 56 includes a first strip 56*a* and a second strip 56*b*. The first strip 56*a* is comprised of hook fasteners and is attached to the mat board 52, and the second strip 56*b* is comprised of loop fasteners and is attached to the rear frame member 112. When the picture frame 10 is in a closed position, the first strip 56*a* and the second strip 56*b* interact with one another and releasably secure the front frame member 50 to the rear support member 100.

Figure 7:
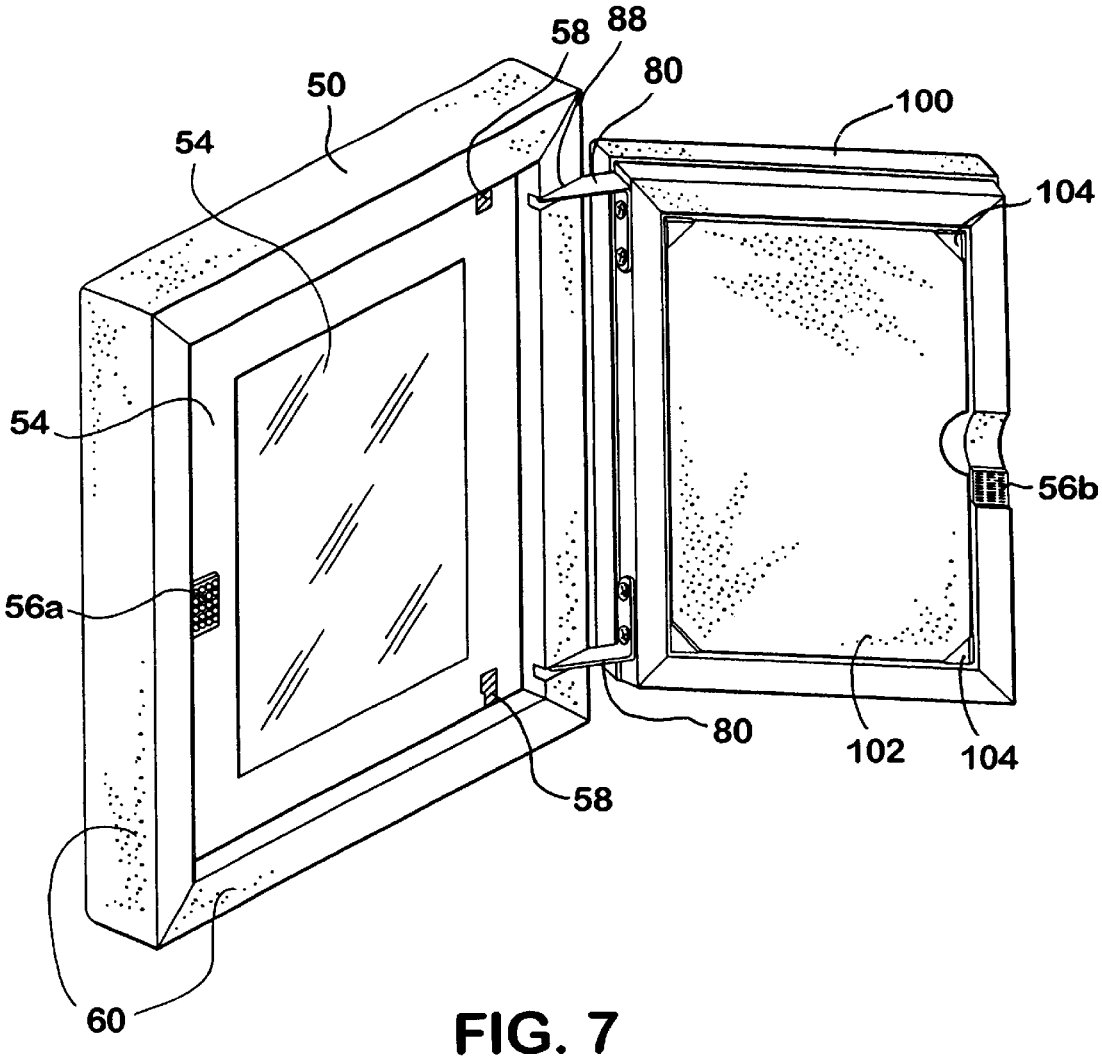
FIG. 7 is a perspective view of an alternative embodiment of the present invention in an open position.
Figure 8:
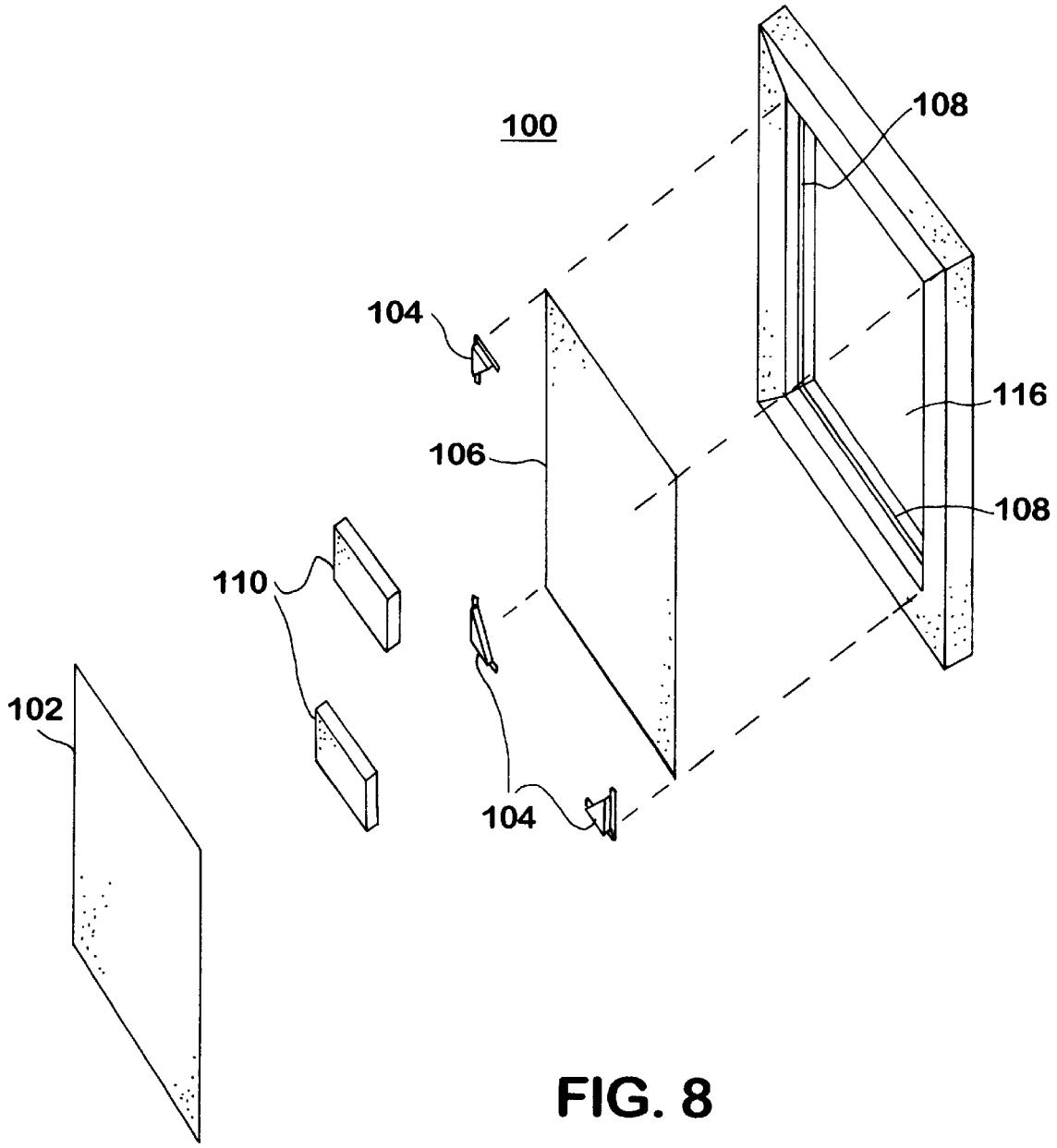
FIG. 8 is an exploded view of the rear support member of the alternative embodiment of the present invention.

In the alternative embodiment of the invention and as shown in FIG. 7, a picture frame 10 with a single picture compartment 116, capable of storing more than one picture in said compartment 116, is provided. The rear support member 100 is comprised of a rear frame member 112 with a groove 108 provided on the inside portion of the rear frame member 112. A rear panel 106 and corner supports 104 are capable of being mounted within the groove 108 of the rear frame member 112. Moreover, an adjustment means 110 and a rear picture support 102 are removably secured to the rear frame member 112 by the corner supports 104. Therefore, in the alternative embodiment of the present invention, the channel 109 is not present and the corner supports 104 are mounted within the groove 108 of the rear panel 106. In the alternative embodiment and as shown in FIG. 10, the corner supports 104 are comprised of a top wall 104*a* connected to a bottom wall 104*b* by side walls 104*c′* and 104*c″*, an opening 104e and a pair of ridges 104*d* which extend perpendicularly to side walls 104*c′* and 104*c″*. The corner supports 104, in the alternative embodiment, are attached to the rear frame member 112 by placing the ridge 104*d* within the groove 108 of the rear frame member 112. Further, each of the corner supports 104 will be placed in one of the respective corners of the rear frame member 112 such that the side walls 104*c′* and 104*c″* will both abut the rear frame member 112 and the opening 104*e* will face the opposing corner of the rear frame member 112.

By allowing the picture compartment support 114, the rear picture support 102 and the mat board 52 to be removable, the number of compartments 116 for storing pictures can be changed by removing the picture compartment support 114, the rear picture support 102 and the mat board 52 and replacing them with an alternative picture compartment support 114, rear picture support 102 and correlating mat board 52. This allows purchasers of the picture frames 10 embodied in the present invention to vary the storage capability of the picture frame 10 without replacing the entire frame 10.

The hinge 80 as used in the picture frame 10 is designed to allow the picture frame 10 to be accessed and to be opened while the frame 10 is mounted on a planer surface such as a wall. Additionally, the hinge 80 is designed to interact with the front frame member 50 and the rear support member 100 without requiring significant retooling of the front frame member 50 or the rear support member 100.

Also, the front frame member 50 is preferably, removably attachable to the rear support member 100. This allows the picture frame user to remove the front frame member 50 from the rear support member 100 and replace it with a front frame member 50 comprised of a different material, i.e., a user may replace a wood front frame member with a plastic front frame member. Thus, the picture frame user can change the look and feel of the picture frame 10 without purchasing an entirely new picture frame 10.

While the invention has been particularly shown and described with reference to a particular embodiment thereof, it will be understood by those skilled in the art that various changes in form and detail may be made therein without departing from the spirit and scope of the invention. The present example and embodiment, therefore, are to be considered in all respects as illustrative and not restrictive, and the invention is not to be limited to the details given herein.

I claim:

1. A picture frame capable of storing and displaying a plurality of pictures, comprising:

a front frame member, the front frame being comprised of a frame surrounding a transparent display window;

a rear support member, the rear support member, including a plurality of picture compartments, where each picture compartment is capable of storing multiple pictures and where the rear support member is hingeably attached to the front frame member;

a rear picture support releasably mounted within the picture compartment;

an adjustment means displaced between the rear picture support and the picture compartment, the adjustment means placing a constant, yet variable, force upon the rear picture support in a direction toward the display window; and attachment means for releasably securing the front frame member to the rear support member.

2. The picture frame defined in claim 1, wherein the transparent display window is made of glass.

3. The picture frame defined in claim 1, wherein the transparent display window is made of plastic.

4. The picture frame defined in claim 1, wherein the picture frame further includes a removable mat board mounted on an inside portion of the transparent display window, the mat board forming a border on the inside portion of the transparent display window.

5. The picture frame defined in claim 4, wherein the mat board is releasably secured to the front frame member by flexible support arms attached to the front frame member.

6. The picture frame defined in claim 4, wherein the mat board defines one display area.

7. The picture frame defined in claim 4, wherein the mat board defines a plurality of display areas.

8. The picture frame defined in claim 1, wherein the rear picture support is automatically adjusting.

9. The picture frame defined in claim 8, wherein the adjustment means is comprised of a sponge material.

10. The picture frame defined in claim 8, wherein the adjustment means is comprised of a spring.

11. The picture frame defined in claim 8, wherein the adjustment means is comprised of a compressible material.

12. The picture frame defined in claim 1, wherein the picture frame further includes a hinge means rotatably and removably attaching the front frame member to the rear support member.

13. The picture frame defined in claim 12, wherein the hinge means is further comprised of an L-shaped member having a first leg and a second leg, where the first leg of the L-shaped member is attached to the rear support member and wherein the second leg is rotatably attached to a support pin, the support pin being further attached to the front frame member.

14. The picture frame defined in claim 13, wherein the front frame member has a hinge slit that runs parallel to the first leg, the first leg of the hinge being capable of rotating within the slit thereby allowing the front frame member to rotate up to 180 degrees while it is mounted on a planar surface.

* * * * *

UNITED STATES PATENT AND TRADEMARK OFFICE

CERTIFICATE OF CORRECTION

PATENT NO. : 6,438,883 B1
DATED : August 27, 2002
INVENTOR(S) : Timothy A. Kacius It is certified that error appears in the above-identified patent and that said Letters Patent is hereby corrected as shown below:

Column 5,
Line 9, insert -- member -- after "the front frame"

Signed and Sealed this

Fifth Day of November, 2002

*Attest:*

*Attesting Officer*

JAMES E. ROGAN
*Director of the United States Patent and Trademark Office*